US007106263B2

(12) United States Patent
Kuehne

(10) Patent No.: US 7,106,263 B2
(45) Date of Patent: Sep. 12, 2006

(54) WINDOW-INTEGRATED ANTENNA FOR LMS AND DIVERSITARY FM RECEPTION IN MOBILE MOTOR VEHICLES

(75) Inventor: Rainer Kuehne, Hildesheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/886,124

(22) Filed: Jul. 6, 2004

(65) Prior Publication Data

US 2005/0024279 A1 Feb. 3, 2005

(30) Foreign Application Priority Data

Jul. 10, 2003 (DE) ..... 103 31 213

(51) Int. Cl.
*H01Q 1/32* (2006.01)

(52) U.S. Cl. ..... 343/713; 343/711; 343/304

(58) Field of Classification Search ..... 343/713, 343/711, 901, 704; 428/192
See application file for complete search history.

(56) References Cited

U.S. PATENT DOCUMENTS

| | | | | |
|---|---|---|---|---|
| 5,029,308 | A * | 7/1991 | Lindenmeier et al. | 343/704 |
| 5,132,161 | A * | 7/1992 | Shibata et al. | 428/192 |
| 6,476,778 | B1 * | 11/2002 | Hussaini et al. | 343/901 |
| 6,603,435 | B1 * | 8/2003 | Lindenmeier et al. | 343/713 |

FOREIGN PATENT DOCUMENTS

| | | |
|---|---|---|
| DE | 36 19 704 | 12/1987 |
| DE | 92 17 173 | 4/1993 |

* cited by examiner

*Primary Examiner*—Don Wong
*Assistant Examiner*—Binh Van Ho
(74) *Attorney, Agent, or Firm*—Kenyon & Kenyon LLP

(57) ABSTRACT

A window-integrated antenna for LMS and FM reception in mobile motor vehicles in which the window pane of the motor vehicle, in conjunction with the line structures of the antenna and the metallic frame enclosing the window pane, is used as the antenna for the reception of LMS and USW signals, the connection points of the line structures being situated in the region of one of the corners formed by the metallic frame, in proximity to which the mechanical component used as the USW/LMS antenna unit is also positioned. The first conductor section of the antenna, which is positioned perpendicularly to the upper horizontal frame part of the metallic frame, is adjoined by a second long conductor section forming an angle preferably of 90° or forming a radius which is preferably implemented as a quarter circle having a small radius, the second conductor section running parallel to the upper horizontal frame part and extending over the largest part of the width of the window pane; and in proximity to the second lateral frame part, the second conductor section is adjoined by a third, likewise short conductor section forming an angle preferably of 90° or forming a radius which is preferably implemented as a quarter circle having a small radius, the third conductor section extending in the direction of the upper horizontal frame part and being connected to a fourth conductor section, forming the loop; the fourth conductor section, forming with the third conductor section an angle preferably of 90° or forming a radius which is preferably implemented as a quarter circle having a small radius, is positioned at a relatively small distance to the upper horizontal frame part and is shorter than the second conductor section of the antenna.

14 Claims, 2 Drawing Sheets

WINDOW-INTEGRATED ANTENNA FOR LMS AND DIVERSITARY FM RECEPTION IN MOBILE MOTOR VEHICLES

FIELD OF THE INVENTION

The present invention relates to a window-integrated antenna for LMS (long-, medium-, shortwave) and diversitary FM reception in mobile motor vehicles, in which the window pane of the motor vehicle is used in conjunction with the line structures of the antenna and the metallic frame enclosing the window pane as the antenna for the reception of LMS and USW (ultra-short wave) signals. The connection points of the line structures are situated in the region of one of the corners formed by the metallic frame, in proximity to which the mechanical component used as the USW/LMS antenna unit, which has an operative connection to the car radio, is also positioned.

BACKGROUND INFORMATION

A window-integrated antenna of this type is described in German Patent No. DE 36 19 704, for example, in regard to a diversitary antenna arrangement, in which the window pane of the motor vehicle is used in conjunction with one or more line structures and the metallic frame surrounding the window pane, as the antenna for the reception of LMS and USW signals. In that case, two antenna conductors are positioned on the window pane of the motor vehicle, of which the one antenna conductor includes three conductor sections. The connection points of the two antenna conductors are situated in a corner of the window pane, in proximity to which the connecting network is also positioned, which has three inputs. Two of the inputs are each connected to one of the connection points of the two antenna conductors. The third input is assigned to the ground point of the metallic frame. The inputs connected to the connection points of the antenna conductors, together with the ground point, in each case form a monopole connection.

A disadvantage of the conventional window-integrated antenna is that the line structures of the antenna conductor which are used are optimized either for LMS reception or for USW reception. In this case, very long line structures are frequently used for the LMS reception, which have no resonance response for USW frequencies. Line structures whose length corresponds to ¼ of the operating wavelength in the USW range and which act in this context as the monopole are used for USW reception. However, these are again subject to the disadvantage that they do not have adequate reception response for LMS frequencies. If the line structures of the antenna conductors are integrated into a windshield made of laminated safety glass, they also always have an interfering effect, since they are in the visible area.

A further window-integrated antenna for motor vehicles is described in German Patent No. DE 92 17 173. Provided therein is an antenna structure which does not visually interfere in the window pane of the motor vehicle and which considers monopoles exclusively for the reception of LMS and diversitary USW signals, but it has been shown that the reception of LMS signals is nonetheless inadequate using antenna structures of this type. In order to allow reliable reception of LMS signals, antennas which may be positioned as a separate antenna on a different spatial point of the motor vehicle, on the bumper or on the spoiler, for example, are therefore frequently additionally used in motor vehicles.

However, the conventional window-integrated antennas frequently have the disadvantage that by taking the reception of different radio signals into consideration, the line structures which are used have at least two line ends such that, based on the requirement for a connection point, an electrical connection must be established in the region of the window pane of the motor vehicle. While this may be performed in a simple manner for a window pane made of single-layer safety glass, it is not possible to electrically connect multiple separate antenna conductors in a window pane made of laminated safety glass, since the manufacturing reliability of the window pane is no longer ensured because of possible air inclusions.

SUMMARY

An object of the present invention is to provide a window-integrated antenna which overcomes the disadvantages of the related art.

In an example embodiment of the present invention, a window-integrated antenna is provided for LMS reception and for diversitary FM reception in mobile motor vehicles, by making possible the reception of both LMS signals and diversitary USW signals with adequate quality using a low number of line structures in a single window pane of the motor vehicle, the costs also being reduced simultaneously by using a low number of conductors, which is related to a reduction of the contacts of the antenna conductors.

These advantages may be achieved by providing a window-integrated antenna in which a single antenna, including four conductor sections positioned perpendicularly to one another, is integrated into the window pane of the motor vehicle for both LMS and FM reception, whose first conductor section, starting from a connection point on the upper horizontal frame part of the metallic frame in the region of one of the two upper corners formed by the metallic frame, is positioned as a short conductor section at a distance to a lateral frame part of the metallic frame situated closest to this conductor section, three further conductor sections adjoining the first conductor section forming an angle preferably of 90° in each case or a radius which is preferably implemented as a quarter circle having a small radius, and the four conductor sections forming a loop. Passive or active assemblies, each of which fulfills reception functions for an LMS or a USW receiver, are accommodated by a mechanical component connected to the connection point via a signal path.

According to one preferred embodiment of the antenna, the first conductor section, which is positioned perpendicularly to the upper horizontal frame part of the metallic frame, is adjoined by a second long conductor section forming an angle preferably of 90° or forming a radius which is preferably implemented as a quarter circle having a small radius, the second conductor section running parallel to the upper horizontal frame part and extending over the largest part of the width of the window pane. In proximity to the second lateral frame part, the second conductor section is adjoined by a third, likewise short conductor section forming an angle preferably of 90° or forming a radius which is preferably implemented as a quarter circle having a small radius. The third conductor section extends in the direction of the upper horizontal frame part and is connected to a fourth conductor section. Thus, the loop is formed. The fourth conductor section, forming with the third conductor section an angle preferably of 90° or forming a radius which is preferably implemented as a quarter circle having a small radius, is positioned at a relatively small distance to the upper horizontal frame part and is shorter than the second conductor section of the antenna.

In this context, the line structures of the antenna and therefore the four conductor sections positioned perpendicularly to one another are positioned in proximity to the upper horizontal frame part of the metallic frame, independently of the particular distance selected to the upper horizontal frame part and to the lateral frame parts of the metallic frame, but also independently of the distance of the conductor sections of the antenna running parallel to one another. This means that depending on the vehicle in which the window-integrated antenna implemented according to the present invention is used, the distances of the conductor sections to one another and to the frame parts may vary. Visual impairment is simultaneously prevented through the positioning of the antenna conductors.

The window-integrated antenna according to the present invention allows both LMS and FM reception with high quality, the LMS reception being made possible because of the electrical length of the line structures of the antenna. Resonance response in the FM range is provided by the formation of the loop, i.e., by the loop-like feedback of the antenna formed by the conductor sections in connection with the capacitive effect of the metallic frame. Resonance response in the FM range is tunable via the entire length of the conductor sections of the antenna.

While an HF line is provided for transmitting the signals between the mechanical components and the car radio, the signal path between the connection point of the antenna and the mechanical component has a plug-in connection, via which a diagnosis is performed, so that active components may be put into operation exclusively when the plug-in connection has been established.

In order to achieve a significantly improved reception pattern for multipath reception, in a further embodiment of the present invention, in addition to the antenna which is integrated into the window pane and includes four conductor sections positioned perpendicularly to one another, a second antenna is provided for FM reception, which is made of a relatively long antenna conductor parallel to the first conductor section of the first antenna, and is connected via a connection point on the upper horizontal frame part of the metallic frame by way of an additional signal path to a mechanical component which accommodates passive or active assemblies for an LMS receiver and for two USW receivers. The signals are transmitted from the mechanical component to the car radio in this case via two HF lines, of which one HF line is assigned to the LMS and USW signals of the first antenna and the second HF line is assigned to the USW signals of the additional antenna integrated in the window pane. In this implementation, according to the present invention, the car radio may advantageously be a radio device having integrated diversity analysis or even an external diversity box.

If this second antenna is used in addition to the first antenna implemented according to the present invention, the connection points of both antennas are positioned closely adjacent to one another, so that the two connection points and the mechanical component may be connected using one single line, which is preferably a flat cable, including both separate signal paths, each signal path having a plug-in connection via which a diagnosis may be performed.

If the second antenna is provided in addition to the antenna integrated in the window pane, which includes four conductor sections positioned perpendicularly to one another, this second antenna generally acts as a monopole. The active length of this antenna is preferably equal to ¼ of the operating wavelength in the FM range, the geometric length being shortened in relation to the active length because of capacitive couplings to the metallic frame.

If the reception result is to be improved even further for multipath reception, according to a further feature of the present invention, in addition to the two antennas, line structures for further antennas are integrated into the window pane of the motor vehicle in particular a third antenna, which is positioned, in regard to its arrangement and implementation, mirror-symmetrically to the second antenna for FM reception on the diametrically opposing lateral frame part of the metallic frame.

Both the line structures of the antenna including four conductor sections positioned perpendicularly to one another and the antenna conductors of the second antenna, but also the line structures of possible further antennas, may be applied through conventional methods which allow the application of the line structures, independently of whether the window pane of the motor vehicle is made of single-layer safety glass or laminated safety glass. In this case, according to the present invention, the window pane of the motor vehicle in which at least the antenna including four conductor sections positioned perpendicularly to one another is integrated may be the windshield, one of the fixed side window panes, or the rear window pane of the motor vehicle, in which or on which one or even two line structures are implemented as a function of the number of antennas. Of course, the antenna implemented according to the present invention may also be transferred to any other window pane, thus, for example, even to the window panes of ships.

Although greatly differing variations are suitable for the positioning of the mechanical component provided in the region of one of the corners formed by the metallic frame, one advantageous positioning of the mechanical component is that it is provided in the inside roof lining of the motor vehicle, an example of which is shown in FIG. 1, which schematically illustrates the mechanical component 15 contained within the inside roof lining 100.

Finally, in the window-integrated antenna implemented according to the present invention, if there are two HF lines between the car radio and the mechanical component, a switching procedure may also be caused in the mechanical component via one HF line by an LF signal generated by the car radio.

In addition to the advantage in regard to LMS and FM reception having high quality and a cost-effective manufacture achieved by the present invention, which results in particular from the implementation of only one line structure or two line structures on or in the window pane of the motor vehicle, the close proximity of the connection points is also advantageous for the construction of integrated, passive or active circuit parts which provide separate signal paths for the different frequency bands, but are positioned in one single housing. In particular, for a multi-antenna system, only one single housing is then necessary as a carrier of the active and passive assemblies. Simultaneously, the number of connection points and therefore the number of necessary contact points of the antenna conductors and the connection lines to the downstream circuit parts is reduced. Minimal cabling results therefrom, in addition to a minimum of mechanical components. The reception system is advantageous precisely for diversity systems, because multiple different radio services may be supplied to the downstream electronic components via one single connection point of the antenna. Simultaneously, the window-integrated antenna according to the present invention allows equipment variations to be provided very easily, without the metallic vehicle body having to be changed or different housings having to be provided as the carrier of the active or passive assemblies and finally having to be constructed so it may be integrated.

In a further embodiment of the present invention one single antenna (4), including four conductor sections (5, 6, 7, 8) positioned perpendicularly to one another, is integrated in window pane (2) of the motor vehicle for both LMS and for FM reception; first conductor section (5) of the antenna, originating from a connection point (9) on the upper horizontal frame part (1) of metallic frame (3) in the region of one of the two upper corners (10) formed by metallic frame (3), is positioned as a short conductor section (5) at a distance to lateral frame part (11 or 12) of metallic frame (3) situated closest thereto, and is adjoined by three further conductor sections (6, 7, 8), forming an angle preferably of 90° in each case or a radius which is preferably implemented as a quarter circle having a small radius, and forming a loop (13); a mechanical component (15), which is connected to connection point (9) via a signal path (14), accommodates passive or active assemblies (16, 17) which fulfill reception functions for an LMS receiver and a USW receiver. In this case, remote powering means DC voltage supply, which is already used in many vehicles.

BRIEF DESCRIPTION OF THE DRAWINGS

In the following, the present invention is described in greater detail in exemplary embodiments on the basis of the attached figures.

DETAILED DESCRIPTION OF EXAMPLE EMBODIMENTS

Figure 1:
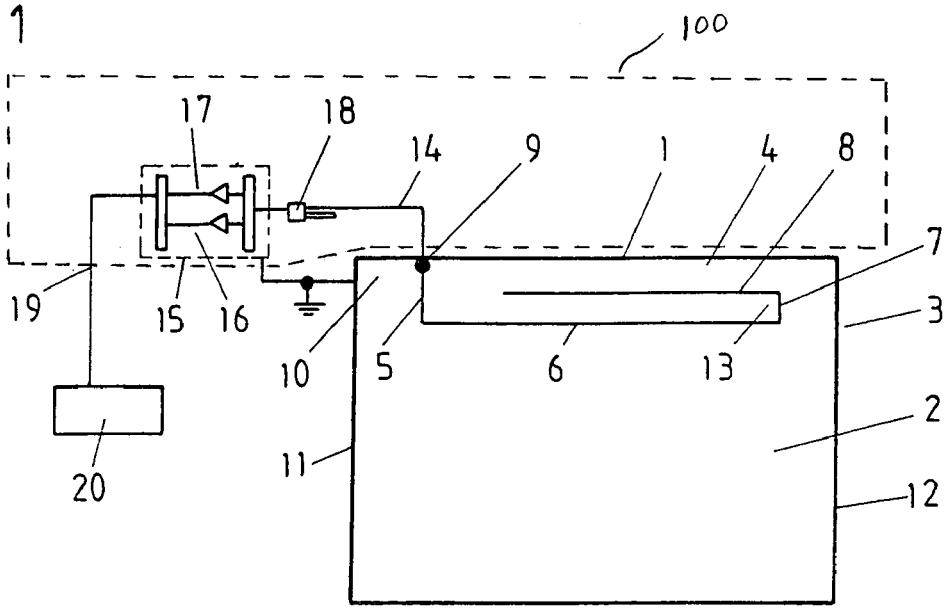
FIG. 1 shows a window-integrated antenna for LMS and FM reception in mobile motor vehicles having a line structure for an antenna.

As shown in FIG. 1, the line structure of an antenna 4 for the reception of LMS and USW signals, which is integrated in window pane 2 by applying the line structure of antenna 4 using known methods, independently of whether window pane 2 is made of single-layer safety glass or laminated safety glass, is positioned in proximity to upper horizontal frame part 1 of metallic frame 3, which encloses window pane 2 in the form of a front windshield of a motor vehicle. In this case, antenna 4 includes four conductor sections 5, 6, 7, 8 positioned perpendicularly to one another, of which first conductor section 5 is connected to connection point 9, which is situated in the region of upper corner 10 formed by metallic frame 3. First conductor section 5 of antenna 4 is positioned as a short conductor section at a distance to lateral frame part 11 of metallic frame 3 and simultaneously perpendicularly to upper horizontal frame part 1 of metallic frame 3. Second conductor section 6, which is positioned parallel to upper horizontal frame part 1, adjoins first conductor section 5 forming an angle of 90° or a quarter circle. In this case, the angle will have a value of approximately 90°. As a function of the manufacturing method, a radius in the form of a quarter circle having a small radius may also be provided. The second conductor section extends over the greater part of the width of window pane 2. Third conductor section 7, which extends as a short conductor section in the direction of upper horizontal frame part 1, adjoins the second conductor section in proximity to second lateral frame part 12 of mechanical frame 3, forming an angle of 90° or a quarter circle. Finally, fourth conductor section 8, which is positioned at a relatively small distance to upper horizontal frame part 1 and is shorter than second conductor section 6, adjoins third conductor section 7 forming an angle, also of 90°, and forming a loop 13.

FIG. 1 also shows that connection point 9 of antenna 4 is connected via a signal path 14 to a mechanical component 15, which is positioned in proximity to corner 10 of metallic frame 3 and accommodates passive or active assemblies 16, 17, which fulfill reception functions for an LMS receiver and a USW receiver. In this case, signal path 14 has a plug-in connection 18, via which a diagnosis is performed. Therefore, active components may only be put into operation when the plug-in connection has been established. The signals are transmitted between mechanical component 15 and car radio 20 via HF line 19.

Figure 2:
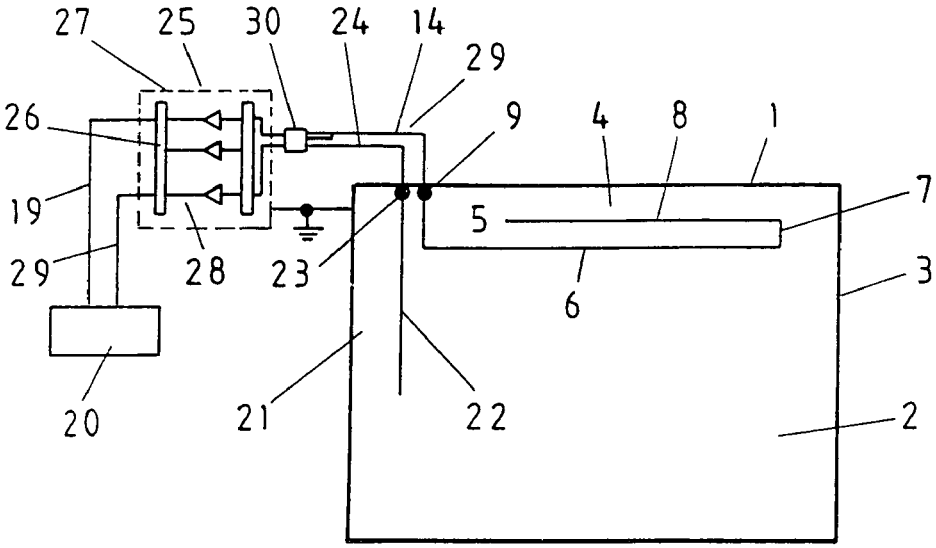
FIG. 2 shows the window-integrated antenna according to FIG. 1 having the line structure of an additional second antenna.

As shown in FIG. 2, in addition to antenna 4, including four conductor sections 5, 6, 7, 8 positioned perpendicularly to one another, of which conductor section 5 is again connected to connection point 9, a second antenna 21 is provided for FM reception, which is used for further improving the reception pattern for multipath reception. This antenna includes a relatively long antenna conductor 22 running parallel to first conductor section 5 of antenna 4. Via connection point 23, which is also positioned on upper horizontal frame part 1 of metallic frame 3 enclosing window pane 2, antenna conductor 22 of second antenna 21 is connected via an additional signal path 24 to a mechanical component 25, which, to fulfill the reception function, also accommodates passive or active assemblies 26, 27, 28, but not, in contrast to mechanical component 15 shown in FIG. 1, only for one LMS receiver, but rather for two USW receivers. The signals are transmitted here between mechanical component 25 and car radio 20 via two HF lines 19, 29. While HF line 19 is again assigned to the LMS and USW signals of antenna 4, HF line 29 is assigned to the USW signals of additional antenna 21. Since connection points 9, 23 of antennas 4, 21 are positioned closely adjacent to one another, connection points 9, 23 and mechanical component 25 are connected using one single line 29, which is a flat cable, including both signal paths 14, 24. Originating from both signal paths 14, 24, each signal path 14, 24 is assigned a plug-in connection 30 which allows a diagnosis to be performed.

Figure 3:
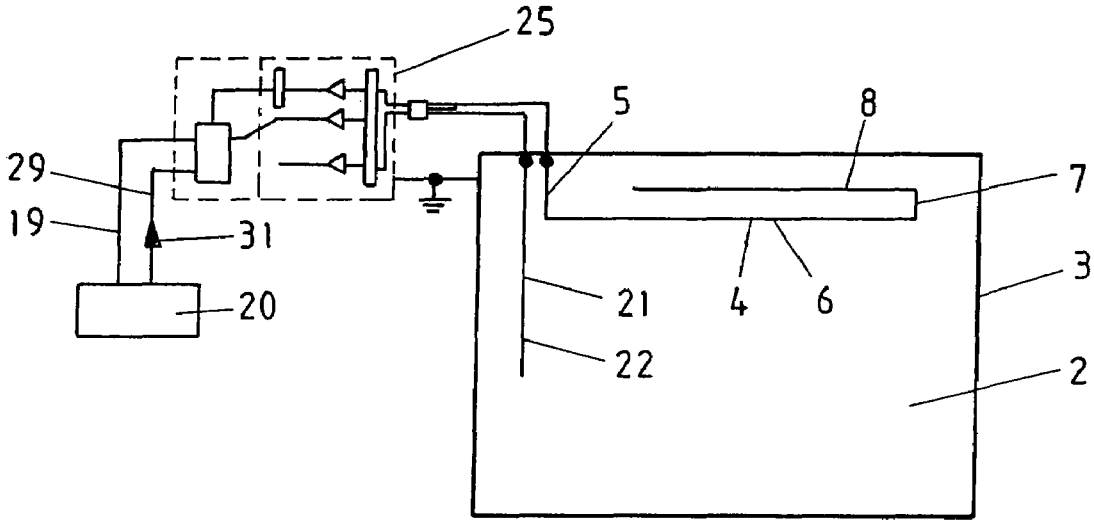
FIG. 3 shows the window-integrated antenna according to FIG. 2 in a further example embodiment.

The window-integrated antenna shown in FIG. 3 generally corresponds to the implementation of the window-integrated antenna shown in FIG. 2. This means that two antennas 4, 21 are also integrated here into window pane 2 enclosed by metallic frame 3. While antenna 4 again includes four conductor sections 5, 6, 7, 8 positioned perpendicularly to one another, antenna 21 is formed by antenna conductor 22 running parallel to first conductor section 5 of antenna 4. However, in the window-integrated antenna in this figure, in contrast to the antenna in FIG. 1, a switching procedure is induced in mechanical component 25 via HF line 29 through an LF signal 31 generated by car radio 20.

What is claimed is:

1. A window-integrated antenna for LMS and FM reception in a mobile motor vehicle, comprising:

a window pane in the motor vehicle;

a metallic frame enclosing the window pane; and a first antenna, the window pane, line structures of the first antenna and the metallic frame being used as an antenna for reception of LMS and USW signals, a first point of the first antenna being situated in a region of one of the corners formed by the metallic frame, in proximity to which a mechanical component used as a USW/LMS antenna unit is also positioned;

wherein the first antenna includes four conductor sections positioned perpendicularly to one another, the first antenna being integrated into the window pane of the motor vehicle for both LMS and FM reception, a first short one of the conductor sections of the first antenna originating from a first-connection point on an upper horizontal frame part of the metallic frame in a region of one of two upper corners formed by the metallic frame and being positioned at a distance to a first lateral frame part of the metallic frame situated closest thereto, three further ones of the conductor sections adjoining the first one of the conductor sections forming one of: i) an angle of 90° in each case, or ii) a radius which is implemented as a quarter circle having a small radius, the four conductor sections forming a loop, and wherein the mechanical component is connected to the first connection point via a signal path and accommodates passive or active assemblies which provide reception functions for an LMS or a USW receiver, and wherein a resonance response in FM range is provided by the formation of the loop in connection with a capacitive effect of the metallic frame.

2. The window-integrated antenna as recited in claim 1, wherein the first one of the conductor sections is adjoined by a second long one of the conductor sections and one of: i) forming an angle of 90°, or ii) forming a radius which is implemented as a quarter circle having a small radius, the second one of the conductor sections running parallel to the upper horizontal frame part and extending over a largest part of a width of the window pane, and wherein in proximity to a second lateral frame part, the second conductor section is adjoined by a third short one of the conductor sections and one of: i) forming an angle of 90°, or ii) forming a radius which is implemented as a quarter circle having a small radius, the third one of the conductor sections extending in a direction of the upper horizontal frame part and being connected to a fourth one of the conductor sections, forming the loop; the fourth conductor one of the sections, forming with the third one of the conductor sections one of: i) an angle of 90°, or ii) a radius which is implemented as a quarter circle having a small radius, the fourth one of the conductor sections being positioned at a small distance to the upper horizontal frame part and being shorter than the second one of the conductor sections of the antenna.

3. The window-integrated antenna as recited in claim 2, wherein the four conductor sections, independently of a distance selected to the upper horizontal frame part and to the first and second lateral frame parts of the metallic frame and independently of a distance of the four conductor sections relative to one another, are positioned in proximity to the upper horizontal frame part of the metallic frame.

4. The window-integrated antenna as recited in claim 3, further comprising:

an HF line configured to transmit signals the signals between the mechanical component and a car radio.

5. The window-integrated antenna as recited in claim 4, wherein a signal path between the first connection point of the first antenna and the mechanical component has a plug-in connection for performing a diagnosis.

6. The window-integrated antenna as recited in claim 5, further comprising:

a second antenna configured to provide FM reception, the second antenna including a long antenna conductor running parallel to the first one conductor sections of the first antenna, is connected via a second connection point on the upper horizontal frame part of the metallic frame by way of an additional signal path to a second mechanical component, which accommodates passive or active assemblies for an LMS receiver and two USW receivers.

7. The window-integrated antenna as recited in claim 6, further comprising:

two HF lines configured to transmit signals between the second mechanical component and the car radio, one of the HF lines being assigned to LMS and USW signals of the first antenna, and the second one of the HF lines being assigned to USW signals of the second antenna.

8. The window-integrated antenna as recited in claim 7, wherein the first and second connection points are positioned closely adjacent to one another, so that connections between the first and second connection points and the mechanical component may be produced using one single line including both separate signal paths, both signal paths being assigned a plug-in connection able to perform a diagnosis.

9. The window-integrated antenna as recited in claim 8, wherein the one single line is a flat cable.

10. The window-integrated antenna as recited in claim 8, wherein line structures for a third antenna are integrated in the window pane, the third antenna being positioned, in regard to its arrangement and implementation, in mirror-symmetry to the second antenna for FM reception on a diametrically opposing lateral frame part of the metallic frame.

11. The window-integrated antenna as recited in claim 10, wherein the four conductor sections of the first antenna, the long antenna conductor of the second antenna, and line structures of further antennas, are applied through customary methods allowing application of line structures, independently of whether the window pane of the motor vehicle is made of single-layer safety glass or laminated safety glass.

12. The window-integrated antenna as recited in claim 1, wherein the mechanical component is positioned in an inside roof lining of the motor vehicle.

13. The window-integrated antenna as recited in claim 7, wherein the mechanical component may perform a switching procedure as a function of an LF signal generated by the car radio on the HF line.

14. The window-integrated antenna as recited in claim 1, wherein active elements in the mechanical component are remotely powered by the car radio via at least one of HF or LF lines.

* * * * *